US010518966B2

(12) United States Patent
Bui

(10) Patent No.: US 10,518,966 B2
(45) Date of Patent: Dec. 31, 2019

(54) COLLAPSIBLE SHIPPING CONTAINER WITH CAM LOCK MOUNTING BRACKET

(71) Applicant: FEU COLLAPSE LLC, Tooele, UT (US)

(72) Inventor: Le Bui, Tustin, CA (US)

( * ) Notice: Subject to any disclaimer, the term of this patent is extended or adjusted under 35 U.S.C. 154(b) by 44 days.

(21) Appl. No.: 15/979,156

(22) Filed: May 14, 2018

(65) Prior Publication Data

US 2019/0344958 A1 Nov. 14, 2019

(51) Int. Cl.
*B65D 88/52* (2006.01)
*B65D 19/12* (2006.01)

(52) U.S. Cl.
CPC ..... *B65D 88/522* (2013.01); *B65D 19/12* (2013.01); *B65D 2519/00273* (2013.01); *B65D 2519/00288* (2013.01); *B65D 2519/00323* (2013.01); *B65D 2519/00497* (2013.01)

(58) Field of Classification Search
CPC ..... B65D 19/22; B65D 88/522; B65D 2519/009; B65D 2519/00895; B65D 2519/0089; B65D 2519/00875; B65D 2519/0087; B65D 2519/00273; Y10T 292/1043; Y10T 292/1051; Y10T 292/1063; Y10T 292/1083; Y10T 292/0911; Y10T 292/0926; Y10T 292/0937; Y10T 292/0951; Y10S 292/32
USPC ..... 220/1.5
See application file for complete search history.

(56) References Cited

U.S. PATENT DOCUMENTS 4,355,732 A * 10/1982 Nessfield ..... B65D 88/522 108/55.3
4,527,765 A * 7/1985 Dorpmund ..... B65D 88/522 248/346.3
2015/0042108 A1* 2/2015 Okawa ..... E05B 81/15 292/194
2015/0097378 A1* 4/2015 Graute ..... E05B 77/34 292/194

* cited by examiner

*Primary Examiner* — Stephen J Castellano
(74) *Attorney, Agent, or Firm* — Fulwider Patton LLP

(57) ABSTRACT

A shipping container is disclosed that can readily transform from an upright to a collapsed configuration to increase efficiencies in shipping. A locking mechanism maintains the container in the upright position until it requires collapsing, using a cam lock configuration that captures a rotatable cam using a pin to lock the mechanism, and a release pin is rotated to unlock the mechanism.

3 Claims, 4 Drawing Sheets

COLLAPSIBLE SHIPPING CONTAINER WITH CAM LOCK MOUNTING BRACKET

BACKGROUND

The present invention is generally related to collapsible shipping containers, and more particularly to a shipping container that can be stacked when empty to improve efficiency and reduce transportation costs and emissions.

For decades the importation of ocean-going sea containers has had a substantial impact on the availability of goods for consumption and manufacturing in the United States and abroad. Unfortunately, the trade lanes have suffered a huge laden volume imbalance where as much as four to five laden containers coming inbound only to realize about one laden container moving outbound. This imbalance is due in part to other countries ability to produce goods at a lower price or receiving subsidies to sell or market their goods to the United States. As a result, the utilization of the container has, for the most part, been one direction. This imbalance means that container lines are paid for the one-way import and are compelled to move or reposition the empty containers back to a foreign port with a significant financial cost to the steamship lines (this cost is in the billions of dollars annually). Transportation intermediaries are essentially moving air (the empty space inside the container) back to the origin foreign port(s) while emitting pollutants as the containers are repositioned back to these origin ports.

The cargo containers in use today have become standardized in dimension and structural, and are such that they can be easily, conveniently and securely stacked vertical in a side by side and end to end relationship to maximize the use of hold and deck space on ships and the like, on which such containers are placed. Trailers are standardized to carry the containers for delivery by trucks and the like.

The principal shortcoming found in the use of these cargo containers, as cited above, resides in the fact that day to day commerce can require that these containers be transported empty from a station or site of delivery of cargo to a next site or station for receipt or loading of cargo. Such transporting of empty containers is non-profitable since each such container occupies valuable and costly space on the ship that could otherwise accommodate a loaded or filled container. Further, the handling and shipping of both loaded and empty containers creates a multitude of other problems. One such problem resides in arranging light, empty containers and heavy, loaded containers aboard ships in such a manner that the ships are properly and safely trimmed.

When transporting a high percentage of empty containers, the voyage of such ships is uneconomical and must be made up somewhere along the way with increased costs of goods and shipping. Accordingly, large economic savings in shipping by containers could be realized if empty containers could be folded or collapsed so that they occupy a fraction of the space they occupy when in their expanded configuration. For example, if three or more containers when collapsed could occupy the space of one container in its normal configuration, the cost of shipping empty collapsed containers would be dramatically reduced.

The prior art has proposed a number of nesting cargo container structures intended to effectively reduce the space required for their shipment when they are empty. While certain proposed nesting containers might well serve such an end, it is understood that they are seriously wanting in certain material respects. For example, a shortcoming found in space saving cargo containers proposed by the prior art includes the deconstruction of the container with the resultant burden of removable or separable parts which are subject to being misplaced, lost, damaged and/or stolen. Experience has taught that if parts of equipment such as cargo containers can be removed and lost or readily damaged, such parts will be removed, lost and/or damaged in the normal course of their use and that great difficulties and inconveniences will be experienced in maintaining such containers.

The construction of traditional cargo containers are made to comply with ISO standard 1496-1, which specifies dimensional and strength requirements but not construction methods. Cranes provided assistance for handling some loads and the advent of the fork lift truck led to the introduction of palletized loads which avoided handling of individual items when transferring between different types of transport at freight terminals. Palletized loads still offered limitations in relation to the speed of handling and especially in relation to their stacking capacity. This has led to development and widespread adoption of containers.

Various sizes have now become standardized 20' (6 m) long containers are the most common. The width has become standardized at 2438 mm. Containers can be loaded at the source and are easily transferred between different types of transport e.g. road, rail or ship. Forklift trucks can be used to load a container with palletized loads. Pallets are approximately 48"×40" (1200-1000 mm) square. Ten pallet places can be accommodated in a standard container. Large ocean going vessels have been designed for handling the containers which can be stacked one on top of the other perhaps as many as seven high. Containers have the advantage of offering protection to the contents within. There is a constant flow of containers around the globe to meet the requirements for the supply of raw materials and products. To maximize container utilization it is desirable to be able to fill a container whenever it is moved from one location to another, but it has been calculated that 20% of containers are transported empty on repositioning runs.

U.S. Pat. No. 8,783,489 proposes a shipping container that can collapse by having the end doors rotated upward to the ceiling of the empty container, and then having the side walls buckle inward to a collapsed configuration. However, there is not a satisfactory way to lock and unlock the collapsed doors and walls without using a mechanical spreader, and there are there is a need to be able to quickly and reliably lock and unlock the components in place without the need for a spreader apparatus. The present invention solves this need.

SUMMARY OF THE INVENTION

The present invention is a shipping container that solves the problem of the empty return trip inefficiency. Using a collapsible design, four empty containers can be transported in the space previously occupied by one container. This approach provides for a collapsible container design to bring containers back to the port in a collapsed state with only one truck needed instead of four. This major development reduces the resources needed to return containers back to the origin or foreign port and prove to be a significant advancement in the container industry. The invention significantly reduces the costs and emissions associated with the return of the empty containers, and empty repositioning costs are reduced by up to seventy-five percent (75%). The present invention allows the stacking of the collapsed, empty containers into a locked configuration using a securing mechanism that operates with a mechanical spreader to ensure a safe and secure arrangement of the empty containers. The stacked set of four empty containers fit inside the footprint of just one open container and be safely secured for over the road, rail, and ocean transport. Efficiencies for every mode of transportation are present and significant including a reduction in emissions (drayage truck emissions by 37.5%), a reduction in the footprint needed to stack and store containers at terminals, rail, and on the vessel.

The container uses a cam lock mechanism that can be actuated by a spreader or by a human to lock and unlock the container from the collapsed configuration. The locking mechanism comprises

DETAILED DESCRIPTION OF THE PREFERRED EMBODIMENTS

A shipping container is disclosed that collapses when not in use for transporting in the collapsed state to improve the efficiency of the shipping operation. The general details of the operation of the container can found in U.S. Pat. Nos. 8,113,372, 8,783,489, and 9,045,280, the contents of which are fully incorporated herein by reference in their entireties. The details of the collapsing and expansion of the container are omitted in this application for brevity in light of the full description in the aforementioned patents.

Figure 1:
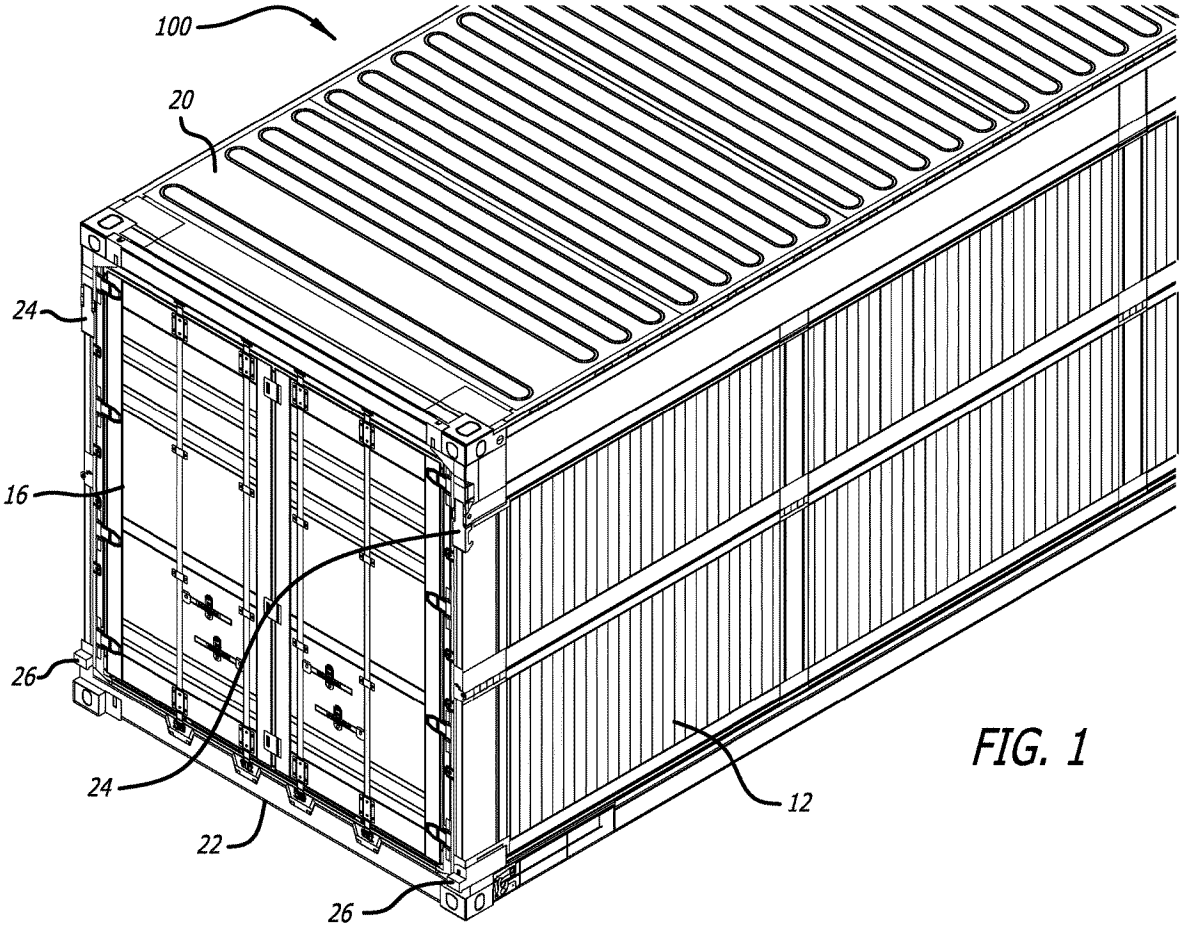
FIG. 1 is an elevated perspective view of a first embodiment of a shipping container of the present invention.
Figure 2:
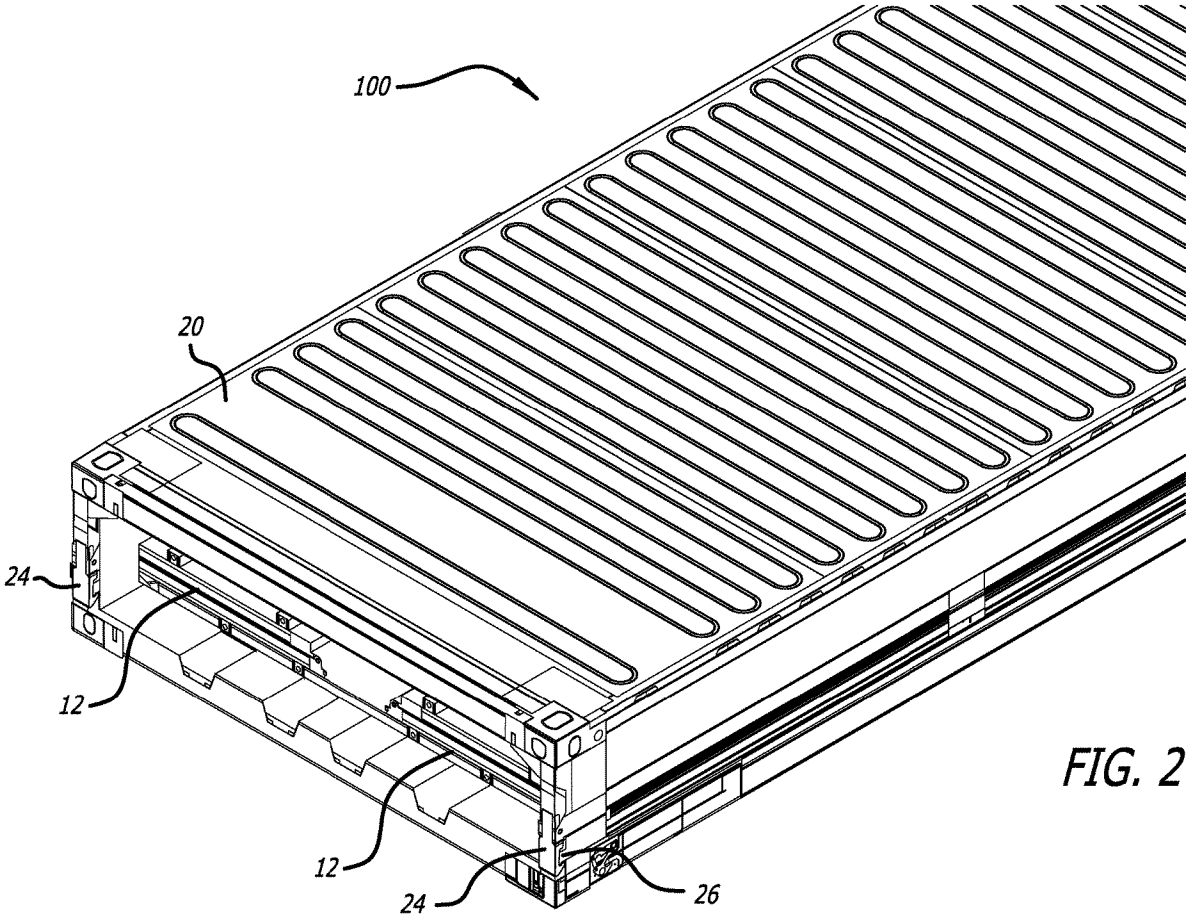
FIG. 2 is an elevated perspective view of the shipping container of FIG. 1 in a collapsed configuration.
Figure 3:
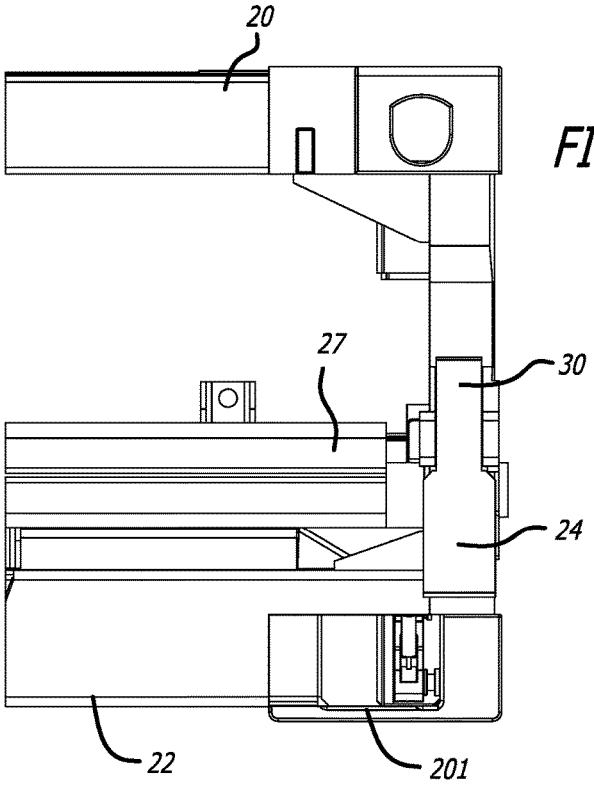
FIG. 3 is an enlarged, front view of the shipping container.
Figure 4:
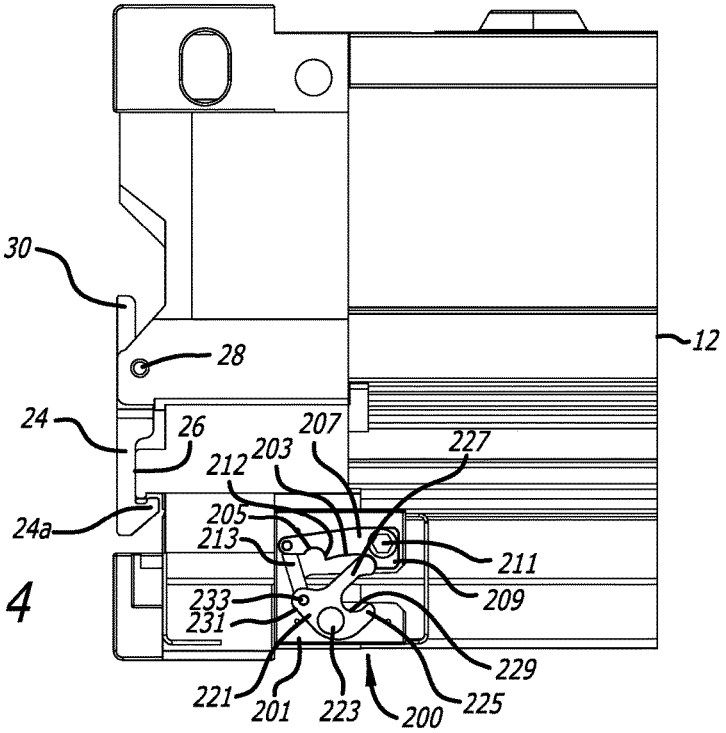
FIG. 4 is an enlarged, side view of the shipping container with a panel removed to show the locking mechanism in the unlocked condition.

FIG. 1 is a perspective view of a shipping container 100 of the present invention. The shipping container has a top wall 20, a bottom wall 22, first and second end walls 16 that rotate about an upper (or lower) edge to couple to the ceiling of the shipping container 100. Once the first and second end walls are secured inside the container, the container is also equipped with left and right walls 12 that have a longitudinal hinge that allows the walls to buckle inward. On the end walls 16 are a pair of pivoting catches 24 that rotate about a pin 28 and hook onto lower lips 26 at the bottom wall 22 to lock the container in the collapsed configuration. FIG. 2 shows the shipping container in the collapsed configuration (with the end wall removed for clarity) with the left and right walls buckled inward so that the container is approximately one fourth the height (28.5 inches) of its original size (97.75 inches). The catches 24 are engaged on the lower wall to keep the containers in a tightly collapsed configuration as shown. The hooked tip 24*a* bears against the lip's recess as shown in FIG. 4 so that the catch 24 remains engages by the force applied by the container until the release lever 30 is engaged. FIG. 3 illustrates a portion of the front of the container in the collapsed configuration with the catch 24 engaged, and a cut-away view displays a side view of the locking mechanism of the present invention.

FIG. 4 illustrates a front view of the locking mechanism for locking the container in the extended, open configuration. A locking mechanism would be located at each of the four corners of the shipping container, and four additional mechanisms at the location where the end walls rotate up against the ceiling. The locking mechanism is also used to lock the end walls 16 against the ceiling of the container as well in a preferred embodiment. In FIG. 4, the container 100 is in the collapsed configuration, and a generally denoted locking mechanism 200 is in an unlocked position. With the locking mechanism in the unlocked condition, the door frame 27 can fold into the collapsed configuration. The locking mechanism 200 includes a mounting bracket 201 onto which is mounted an elongate member 207 having a bottom edge with a first cam surface 203 and a recess 205. A first end 209 of the elongate member 207 is mounted on a release pin 211 having a hexagonal head, the elongate member rotatable about the release pin 211, and an opposite end of the elongate member 207 is attached to a spring 213. The spring 213 pulls down on the elongate member 207 and biases the elongate member toward the bottom of the container. Below the elongate member 207 is a cam 221 mounted on its own pin 223 for rotation thereabout. The cam 221 has a thumb 225 and finger 227 that form a circular recess 229 in between. Opposite the thumb 225 is a lug 231 with a fastener 233 that secures the spring 213.

Figure 5:
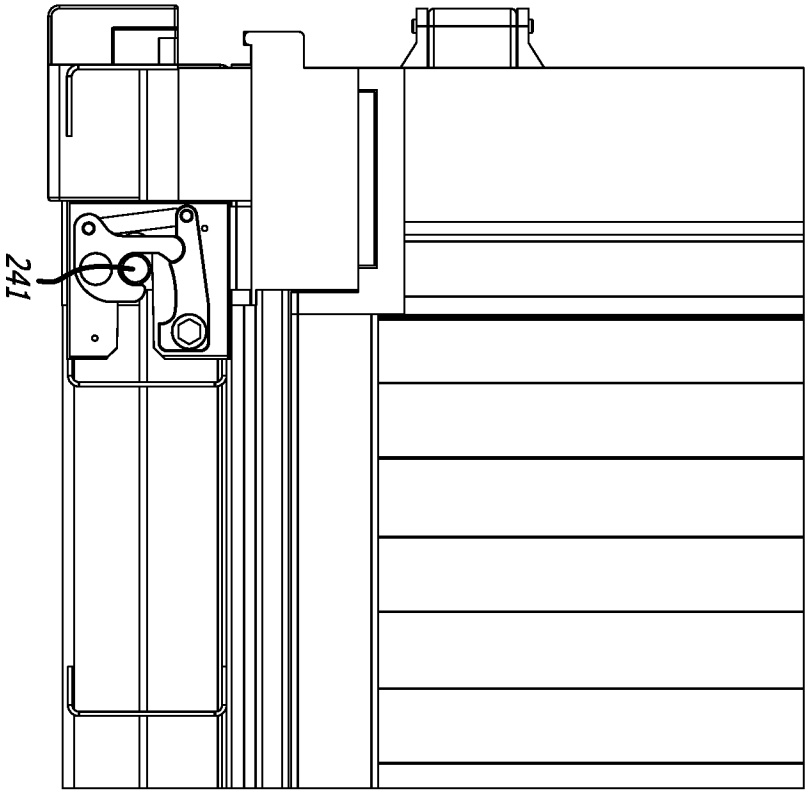
FIG. 5 is an enlarged, side view of the shipping container with a panel removed to show the locking mechanism in the locked condition.

To lock the mechanism, a locking pin 241 is used to rotate the cam 221 from its position in FIG. 4 to its position in FIG. 5. The locking pin 241 can be attached to an automated lever or a rod that is controlled manually. Once the locking mechanism 200 is locked, the door frame will maintain its upright configuration and the container will not collapse until the locking mechanism is unlocked, preventing damage to the containers, its contents, and to surrounding personnel. To lock the device, the locking pin 241 is brought into contact with the circular recess 229, which opens from an inward side of the container. As the locking pin 241 comes into contact with the cam 221, the cam 221 will rotate (the counterclockwise direction in FIG. 5) since the force applied by the locking pin 241 is above the cam pin 223. The cam finger 227 bears against the elongate member 207 as it moves along the cam surface 203, lifting the elongate member 207 against the bias of the spring 213. The cam 221 continues to rotate until the finger 227 reaches the end of the cam surface 203, which terminates in a precipice 212. Upon overtaking the precipice 212, the finger sinks into the recess 205, and the spring 213 snaps the elongate member 207 downward. The cam 221 becomes trapped, since the tangential movement of the finger 227 in the return (i.e., clockwise) direction is blocked by the elongate member as shown in FIG. 5. Only a rotation of the release pin 211 by a hexagonal socket tool to lift the elongate member 207 (or a manual lifting of the elongate member 207 at the spring 213) will free the finger 227 and permit the cam to unlock, or return to its original position. Thus, the locking mechanism reliably and easily prevents premature or accidental release of the upright shipping container while providing a quick and cost effective locking mechanism that is readily operated with a simple tool.

While preferred embodiments of the present invention are described and depicted in this disclosure, the depictions and descriptions are for illustration only and should not be considered limiting. Rather, a person of ordinary skill in the art would readily recognize various modifications and substitutions, and the scope of the present invention is intended to include all such modifications and substitutions. Unless expressly stated herein, the scope of the invention is only measured by the appended claims, using the plain and ordinary meanings of the words used as one of ordinary skill would attribute to those words and terms.

I claim:

1. A foldable shipping container having a collapsed configuration and an erect configuration, the container further comprising a locking mechanism for locking the container in the erect configuration comprising:

a mounting bracket;

a cam rotatable with respect to the mounting bracket about a pin and having a radially extending elongate finger and a lug;

a pivoting elongate member having a bottom edge in contact with the elongate finger, the bottom edge having a cam surface and a recess, and the pivoting elongate member pivoting about a release pin at a first end;

a spring connecting a second end of the pivoting elongate member and the lug of the cam to bias the elongate member against the elongate finger of the cam; and a locking pin pushing the rotating cam to rotate the elongate finger along the cam surface, lifting the elongate member against the bias of the spring, and thereupon into the recess;

wherein the bias of the spring maintains the cam in a trapped position characterized by the location of the elongate finger in the recess of the elongate member; and wherein the locking mechanism is released by rotating the release pin to lift the elongate member against the bias of the spring to release the elongate finger from the recess and rotate the cam to its original position.

2. The foldable shipping container of claim 1, further comprising a catch pivoting on a front surface of the shipping container to prevent the shipping container from expanding from the collapsed configuration.

3. The foldable shipping container of claim 1, wherein the release pin is rotated by a hexagonal slotted tool.

* * * * *